US011167914B2

(12) United States Patent
Accursi

(10) Patent No.: US 11,167,914 B2
(45) Date of Patent: Nov. 9, 2021

(54) CAPSULE FOR MAKING BEVERAGES

(71) Applicant: CAFFITALY SYSTEM S.P.A., Bologna (IT)

(72) Inventor: Giovanni Accursi, Alto Reno Terme (IT)

(73) Assignee: CAFFITALY SYSTEM S.P.A., Gaggio Montano (IT)

( * ) Notice: Subject to any disclaimer, the term of this patent is extended or adjusted under 35 U.S.C. 154(b) by 156 days.

(21) Appl. No.: 16/326,324

(22) PCT Filed: Sep. 19, 2017

(86) PCT No.: PCT/IB2017/055660

§ 371 (c)(1),
(2) Date: Feb. 18, 2019

(87) PCT Pub. No.: WO2018/055511

PCT Pub. Date: Mar. 29, 2018

(65) Prior Publication Data

US 2019/0218023 A1 Jul. 18, 2019

(30) Foreign Application Priority Data

Sep. 23, 2016 (IT) ..... 102016000095975

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS

| | | | |
|---|---|---|---|
| 7,604,826 | B2 | 10/2009 | Denisart et al. |
| 7,685,930 | B2 | 3/2010 | Mandralis et al. |
| 9,394,101 | B2 | 7/2016 | Empl |
| 9,682,814 | B2 | 6/2017 | Bartoli et al. |

(Continued)

FOREIGN PATENT DOCUMENTS

| | | |
|---|---|---|
| EP | 1472156 | 11/2004 |
| EP | 1500358 | 1/2005 |

(Continued)

*Primary Examiner* — Viren A Thakur
*Assistant Examiner* — Chaim A Smith
(74) *Attorney, Agent, or Firm* — Pearne & Gordon LLP

(57) ABSTRACT

A capsule for making beverages, containing a powdered food substance (2) and comprising a cup-shaped containment body (3) that has a bottom portion (5) equipped with a dispensing hole (9), a lower filtering element (14) mounted in the containment chamber (6) and positioned between the powdered food substance (2) and the bottom portion (5), and a sheet of flexible material (19), impermeable to oxygen, mounted in the containment body (3) between the powdered food substance (2) and the dispensing hole (9), and comprising a first layer (20) made of plastic material and a second layer (21) made of aluminium, which are coupled to each other, wherein the first layer (20) comprises one or more through cuts (25), each surrounded by a dispensing zone (26), the first layer (20) being locally detached from the second layer (21) at each dispensing zone (26).

19 Claims, 7 Drawing Sheets

(56) References Cited

U.S. PATENT DOCUMENTS

| | | | | |
|---|---|---|---|---|
| 2004/0228955 | A1 | 11/2004 | Denisart et al. | |
| 2005/0115415 | A1* | 6/2005 | Arrick | B65D 85/8043 99/348 |
| 2006/0219098 | A1 | 10/2006 | Mandralis et al. | |
| 2008/0028946 | A1 | 2/2008 | Kirschner et al. | |
| 2009/0211458 | A1* | 8/2009 | Denisart | B65D 85/8043 99/300 |
| 2010/0034929 | A1* | 2/2010 | Dogan | B65D 85/8043 426/89 |
| 2014/0366745 | A1* | 12/2014 | Goglio | B65D 85/804 99/295 |
| 2015/0108011 | A1 | 4/2015 | Bartoli et al. | |
| 2015/0175347 | A1 | 6/2015 | Empl | |
| 2015/0232263 | A1* | 8/2015 | Talon | B65D 65/38 426/115 |
| 2016/0325921 | A1 | 11/2016 | Empl | |
| 2017/0073153 | A1 | 3/2017 | Bartoli et al. | |
| 2017/0158422 | A1 | 6/2017 | Andreae et al. | |
| 2018/0273287 | A1 | 9/2018 | Stas et al. | |

FOREIGN PATENT DOCUMENTS

| | | |
|---|---|---|
| EP | 1574452 | 9/2005 |
| EP | 1808382 | 7/2007 |
| WO | 03059778 | 7/2003 |
| WO | 2013124811 | 8/2013 |
| WO | 2013189923 | 12/2013 |
| WO | 2015136433 | 9/2015 |
| WO | 2015177591 | 11/2015 |
| WO | 2016111626 | 7/2016 |

* cited by examiner

CAPSULE FOR MAKING BEVERAGES

This invention relates to a capsule for making beverages, of the type containing a powdered food substance that allows a beverage to be made by passing hot water through it. That food substance may be of the soluble type or of the type extractable by infusion (such as roasted and ground coffee).

In particular, this invention relates to a capsule of the type described in patents EP 1 472 156, EP 1 500 358, EP 1 574 452 and EP 1 808 382, that is to say, a capsule able to dispense a beverage directly into a cup below. That capsule comprises a cup-shaped containment body that has a bottom portion equipped with a dispensing hole, that is closed at the top by a closing element and inside which at least one lower filtering element is positioned between the powdered food substance and the bottom portion.

In this type of capsules, the capsules are usually made in such a way as to prevent the passage at least of oxygen towards the powdered food substance and so that at the moment when they are used the machine which uses them only pierces the upper closing element in order to inject water into the capsule. In contrast, the outflow of the beverage is achieved thanks to the fact that, inside them, the capsules comprise a barrier to oxygen made with a sheet of flexible material that, following the injection of water into the capsule, swells and tears against fixed contact elements present in the capsule. In particular, the lower filtering element is practically completely covered with pyramid-shaped spikes that allow tearing of the aluminium sheet that constitutes the barrier, as soon as the latter swells. In order to prevent the torn edges of the aluminium sheet from clogging the filtering element or even from coming out of the capsule (in fact, the many spikes present could reduce the sheet to shreds), in accordance with prior art solutions the filtering element only has openings along its periphery, at the contact zone with the inner wall of the containment body, that is to say, at zone of it relatively far from the pyramid-shaped spikes.

Furthermore, as already indicated, in these prior art capsules the beverage is dispensed directly from the capsule to the cup, that is to say, without contact with any part of the machine. For that purpose, the containment body of the capsule, which is injection moulded, comprises a ring that extends outwards and surrounds the dispensing hole, creating a sort of short tube for guiding the beverage as it flows out, guaranteeing its correct orientation towards the cup below.

In this context the primary technical purpose which forms the basis of this invention is to provide a capsule for making beverages which can be used in the same type of machines that use the capsules described above, but which is made in an alternative way to the prior art capsules.

In particular, the technical purpose of this invention is to provide a capsule for making beverages which uses an alternative opening method in terms of beverage dispensing.

The secondary technical purpose of this invention is to provide a capsule for making beverages in which the containment body can be made by thermoforming.

The technical purpose specified and the aims indicated are substantially achieved by a capsule for making beverages as described in the appended claims.

Further features and the advantages of this invention are more apparent in the detailed description below, with reference to several preferred, non-limiting embodiments of a capsule for making beverages, illustrated in the accompanying drawings, in which.

Figure 1:
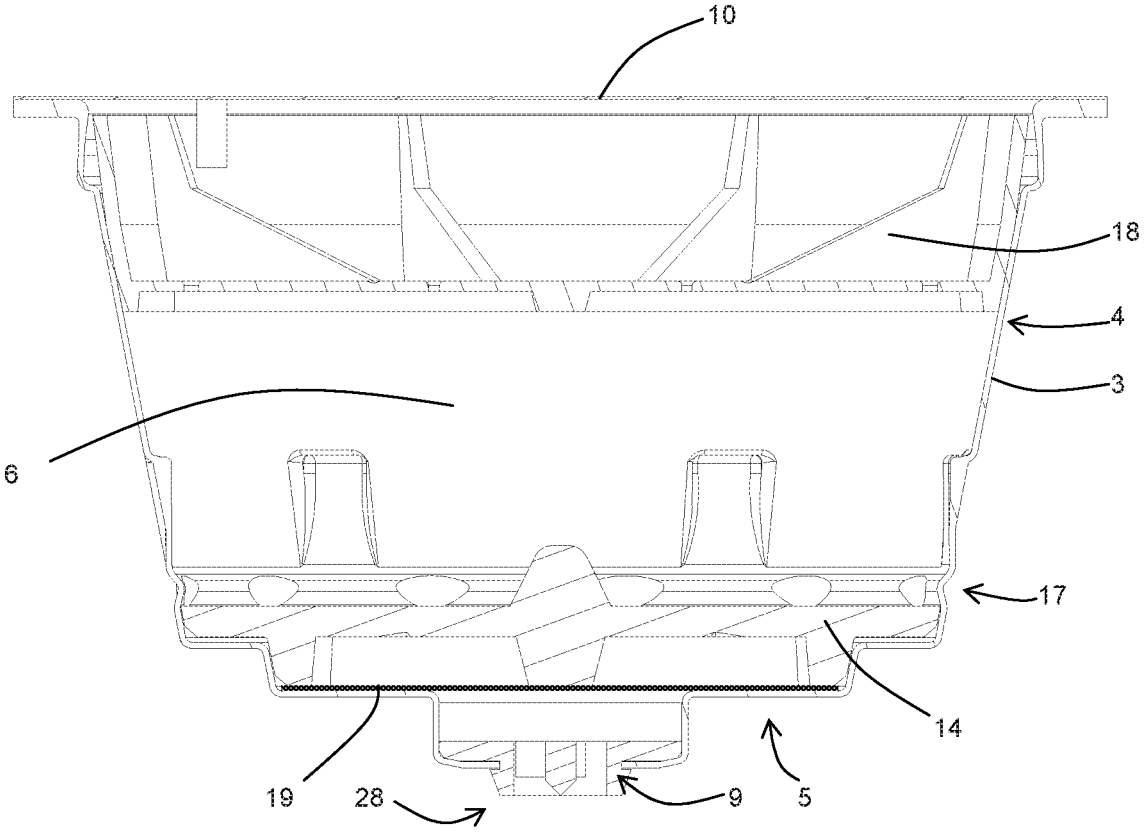
FIG. 1 is an axial section, without the powdered food substance to better illustrate its internal structure, of a capsule for making beverages made in accordance with a first embodiment of this invention.
Figure 2:
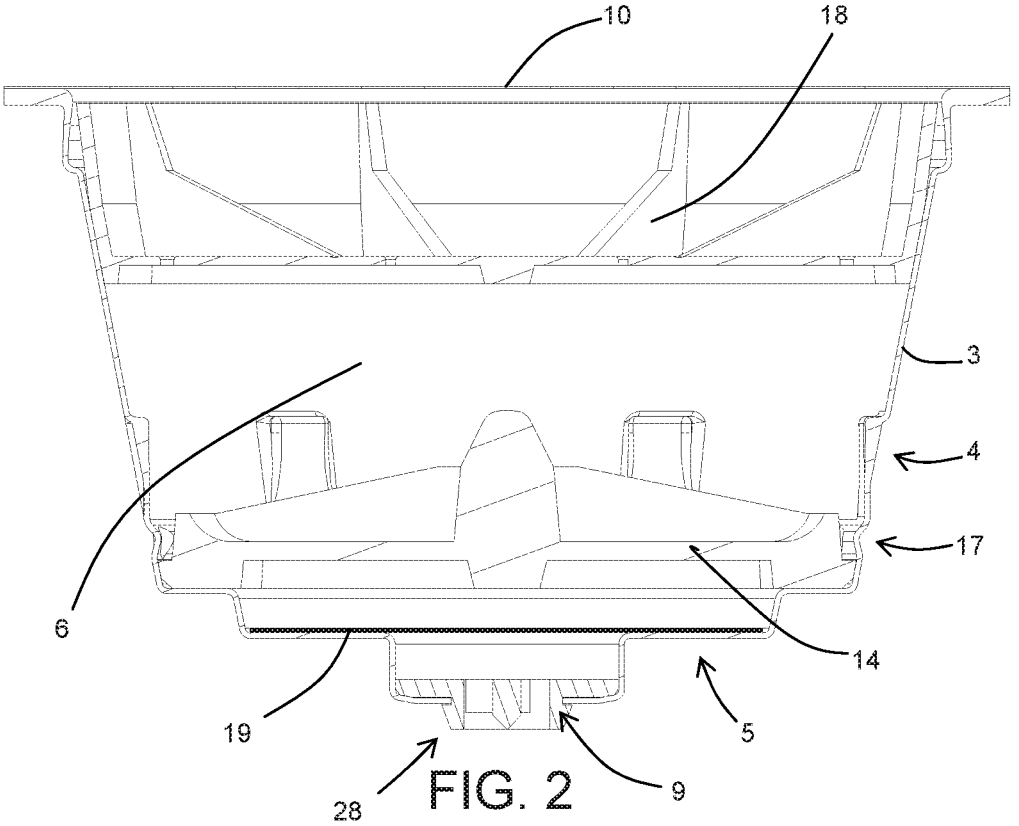
FIG. 2 is an axial section, without the powdered food substance to better illustrate its internal structure, of a capsule for making beverages made in accordance with a second embodiment of this invention.
Figure 3:
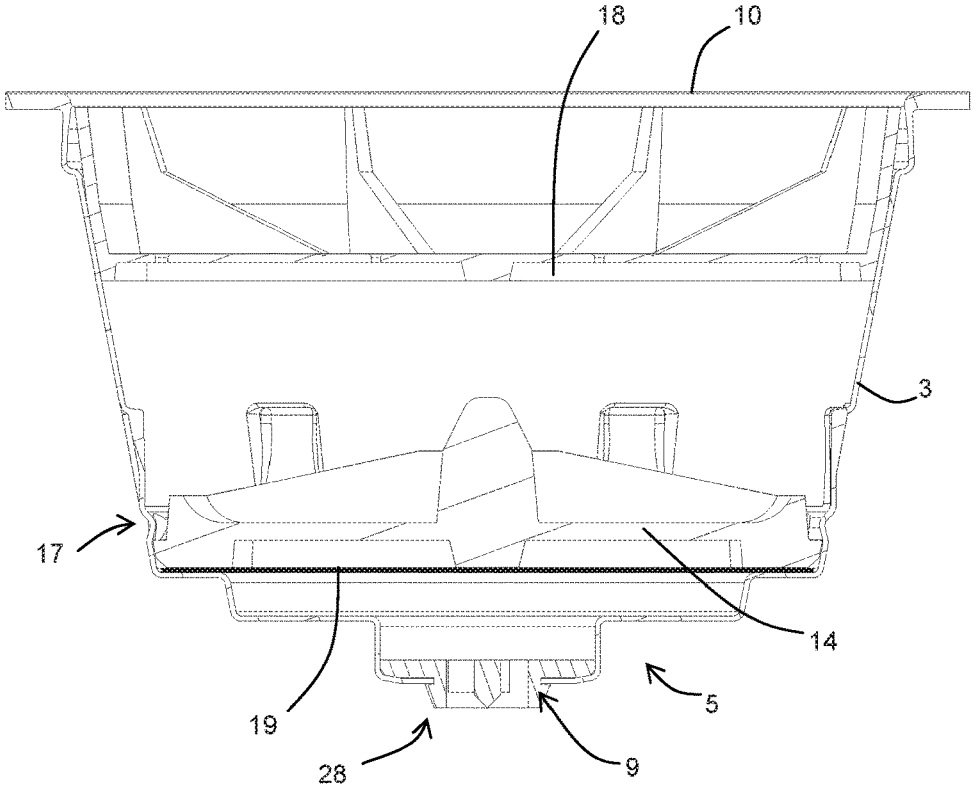
FIG. 3 is an axial section, without the powdered food substance to better illustrate its internal structure, of a capsule for making beverages made in accordance with a third embodiment of this invention.
Figure 4:
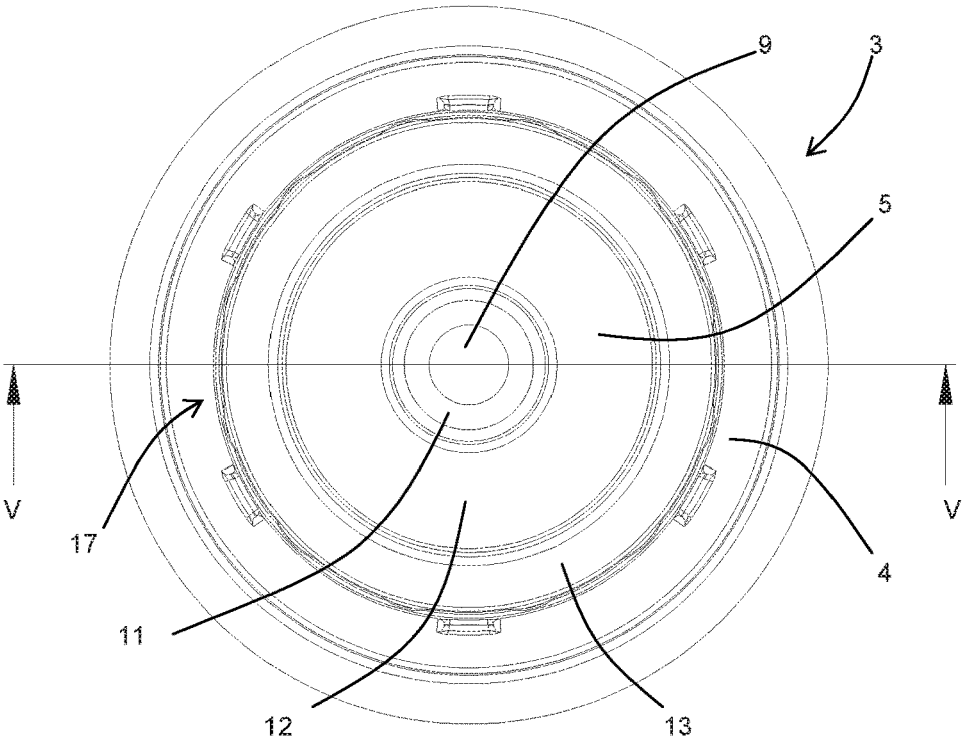
FIG. 4 is a top view of the containment body of the capsules of FIGS. 1 to 3.
Figure 5:
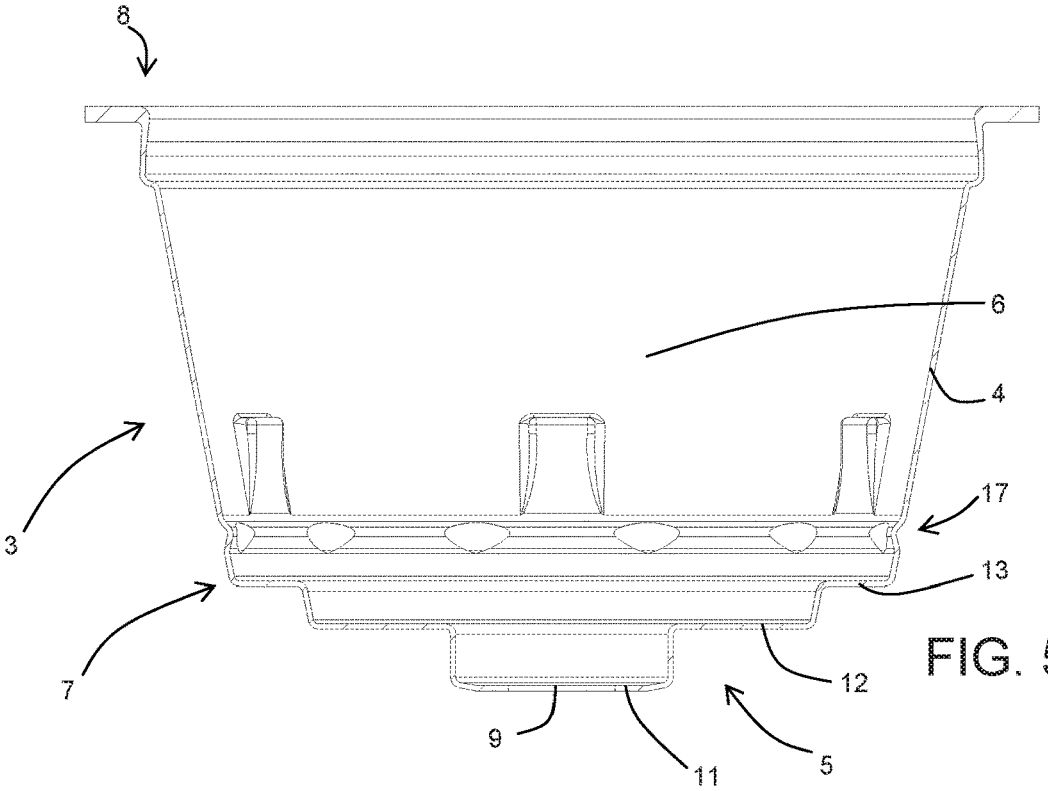
FIG. 5 is a side section view of the containment body of FIG. 4 sectioned according to the line V-V.
Figure 6:
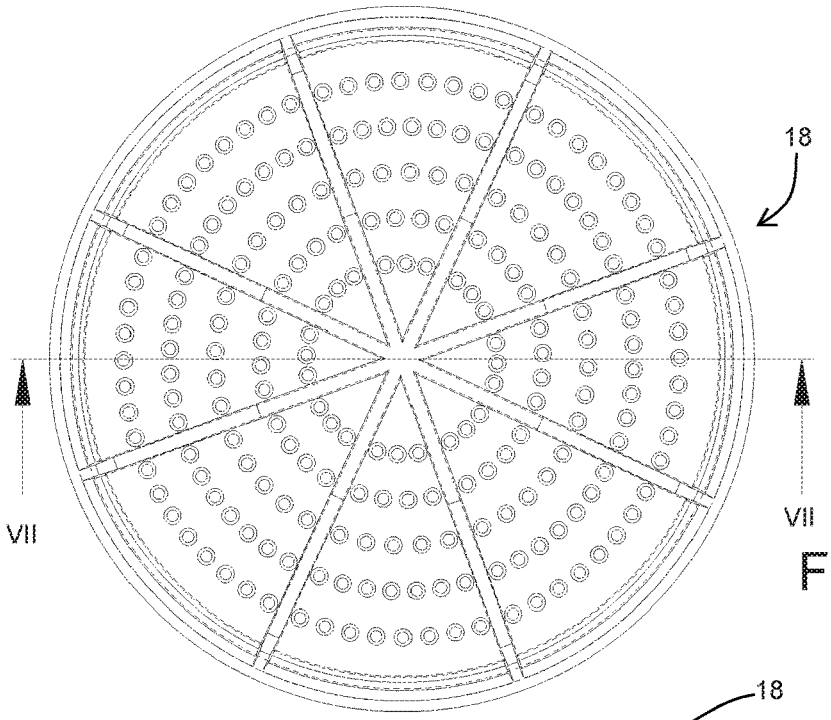
FIG. 6 is a top view of the upper filtering element of the capsules of FIGS. 1 to 3.
Figure 7:
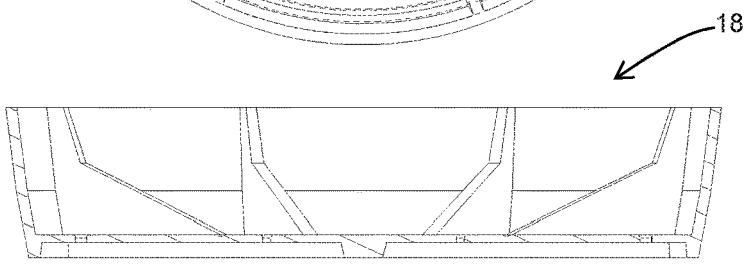
FIG. 7 is a side section view of the upper filtering element of FIG. 6 sectioned according to the line VII-VII.
Figure 8:
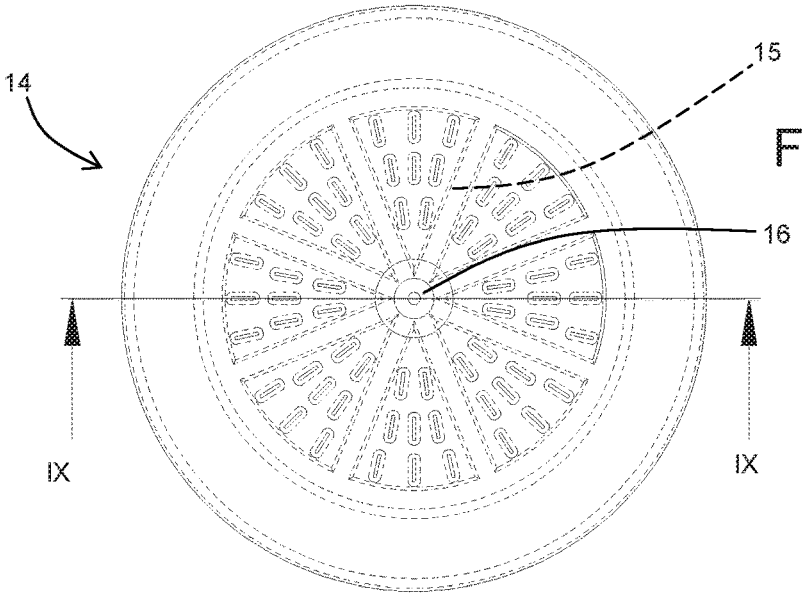
FIG. 8 is a top view of the lower filtering element of the capsule of FIG. 1.

With reference to the above-mentioned figures, the numeral 1 denotes in its entirety a capsule made according to this invention.

Similarly to the prior art capsules, even the capsule 1 according to this invention may contain any powdered food substance 2 that allows a beverage to be made by passing hot water through it, whether it is of the soluble type or the type extractable by infusion (with more or less pressurised water—as described in more detail below, a predetermined extraction pressure always being required).

The capsule 1 comprises first a cup-shaped containment body 3, in which it is possible to identify a tubular lateral wall 4 and a bottom portion 5, and which forms a containment chamber 6 inside it. The tubular lateral wall 4 extends between a first edge 7 and a second edge 8. The bottom portion 5 is connected to the first edge 7 and extends transversally to a central axis of the tubular lateral wall 4 (the central axis also constituting a central axis for the capsule 1). The bottom portion 5 also comprises a dispensing hole 9, advantageously at a central zone of it. A closing element 10, such as a sheet of multi-layer material able to act as a barrier to oxygen, is fixed to the second edge 8 of the tubular lateral wall 4 to close the top of the containment body 3. The fixing is normally performed by sealing or gluing. In the preferred embodiment, the tubular lateral wall 4 and the bottom portion 5 of the containment body 3 are made in a single piece, preferably using a material able to act as a barrier to oxygen, such as a moulded plastic material, or, preferably, a thermoformed multi-layer film.

In the preferred embodiment illustrated in the accompanying figures, the bottom portion 5 of the containment body 3 comprises an inner annular zone 11 that surrounds the dispensing hole 9, a middle annular zone 12 that surrounds the inner annular zone 11 and an outer annular zone 13 that surrounds the middle annular zone 12. The three zones are arranged in steps relative to each other, the inner annular zone 11 being further from the closing element 10 than the middle annular zone 12 and the middle annular zone 12 being further from the closing element 10 than the outer annular zone 13. Finally, the inner annular zone 11, the middle annular zone 12 and the outer annular zone 13 each form a supporting surface extending transversally relative to the central axis. The various supporting surfaces are advantageously concentric relative to the central axis.

Figure 9:
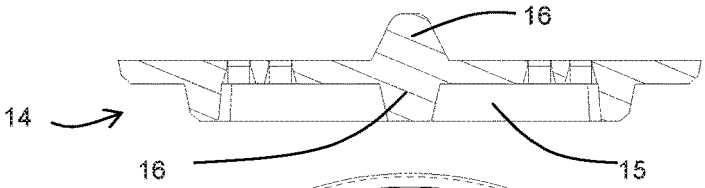
FIG. 9 is a side section view of the lower filtering element of FIG. 8 sectioned according to the line IX-IX.
Figure 10:
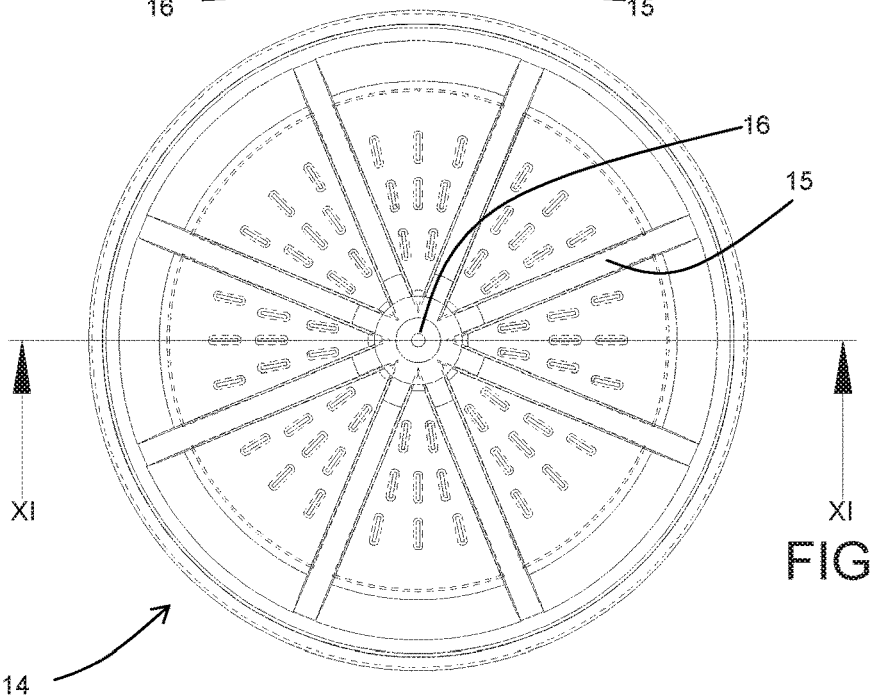
FIG. 10 is a top view of the lower filtering element of the capsules of FIGS. 2 and 3.
Figure 11:
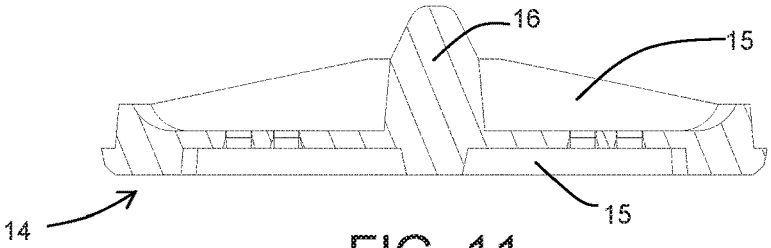
FIG. 11 is a side section view of the lower filtering element of FIG. 10 sectioned according to the line XI-XI.

A lower filtering element 14 is mounted in the containment chamber 6, is positioned between the powdered food substance 2 and the bottom portion 5, and is preferably, but not necessarily, constituted of a rigid or semi-rigid plastic element equipped with a plurality of through holes. The accompanying figures show two example versions of it, both having both radial stiffening ribs 15 and a central bulge 16. In the first case, FIG. 9, the ribs 15 are mainly located on the face of the lower filtering element 14 facing the bottom portion 5, whilst in the second case, FIG. 11, they are mainly on the opposite face. In both cases the lower filtering element 14 rests on the outer annular zone 13 and is held in position by a shaped projection 17 made in the tubular lateral wall 4 (the lower filtering element 14 is inserted in the capsule 1 with a snap-in action).

Moreover, in the preferred embodiment, the capsule 1 also comprises an upper filtering element 18 positioned between the closing element 10 and the powdered food substance 2, the upper filtering element also advantageously constituted of a rigid or semi-rigid plastic element equipped with a plurality of holes and ribs, even if other solutions may be used.

Even the capsule 1 according to this invention, like the prior art capsules, also comprises a sheet of flexible material 19, impermeable to oxygen, mounted in the containment chamber 6 and fixed in an oxygen-tight way to the containment body 3 in order to seal in an oxygen-tight way the part of the capsule 1 that contains the powdered food substance 2.

Figure 14:
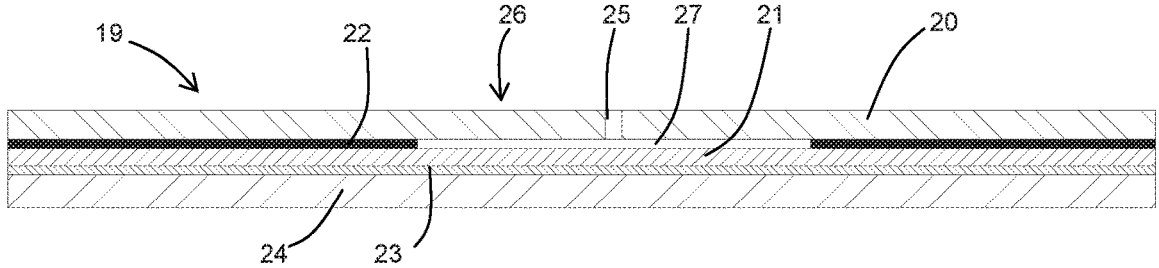
FIG. 14 is a vertical section view of the detail of the sheet of flexible material shown in FIG. 13.
Figure 15:
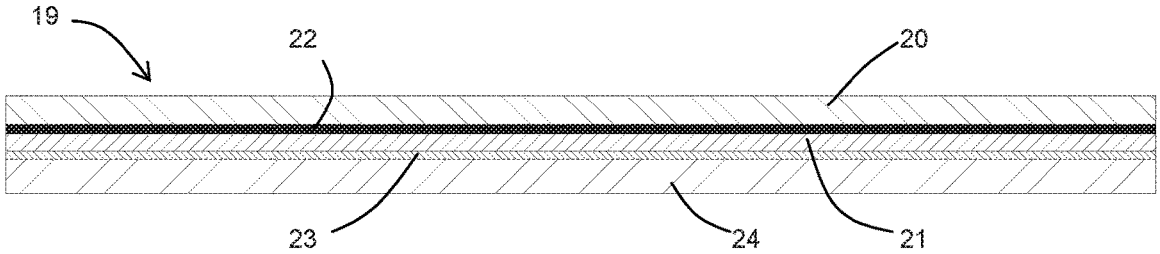
FIG. 15 is a vertical section view of the structure of the sheet of flexible material of FIG. 12 in a zone other than the dispensing zone.
Figure 16:
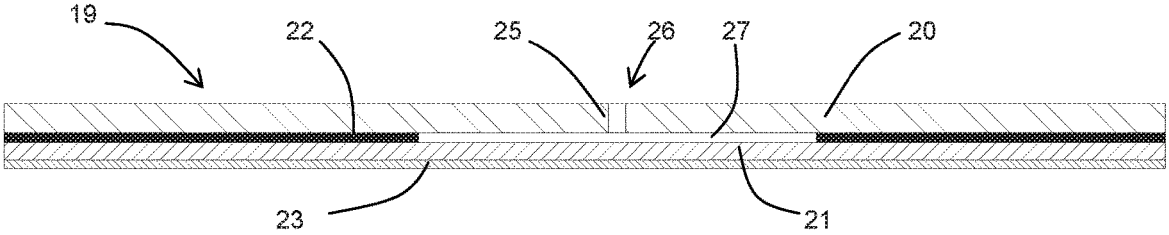
FIG. 16 is a vertical section view of an alternative embodiment of the sheet of flexible material at a dispensing zone similar to that shown in FIG. 14.

Advantageously, the sheet of flexible material 19 comprises at least one first layer 20 constituted of a film made of plastic material, preferably polyethylene or polyester, and one second layer 21 constituted of an aluminium film, which are coupled to each other. The sheet of flexible material 19 is also positioned between the powdered food substance 2 and the dispensing hole 9, with the first layer 20 interposed between the powdered food substance 2 and the second layer 21. In general, the sheet of flexible material 19 may also comprise a layer of adhesive 22 interposed between the first layer 20 and the second layer 21 to guarantee that they adhere to each other, and/or a layer of lacquer 23 applied to the second layer 21 on a face of it opposite to that facing the first layer 20. The embodiment comprising the four layers described above is illustrated in FIG. 16. In other, more complex embodiments, the sheet of flexible material 19 may also comprise a layer 24 of intertwined plastic fibres, joined to the second layer 21 on the same side as the above-mentioned layer of lacquer 23, in such a way that the second layer 21 remains interposed between the first layer 20 and the layer 24 of intertwined plastic fibres. In particular, the layer 24 of intertwined plastic fibres is advantageously constituted of woven or non-woven polyester. This embodiment with five layers is illustrated in FIGS. 14 and 15.

In the preferred embodiment, the thicknesses of the various layers are as follows:

polyethylene film: 10 μm±4 μm;
layer of adhesive 22: 4 μm±2 μm;
aluminium film: 7 μm±3 μm;
layer of lacquer 23: 4 μm±2 μm;
woven or non-woven polyester: 11 μm±3 μm.

In general, it is advantageously the case that the thickness of the layer of aluminium (second layer 21) is selected in such a way that the second layer 21 can tear autonomously when the difference in the pressure acting on its two faces is equal to at least 2 bar (at least at the dispensing zone described below).

Figure 12:
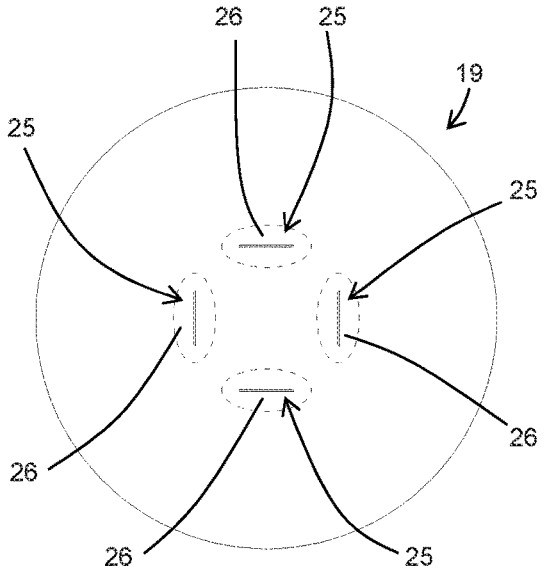
FIG. 12 is a top view of a preferred embodiment of the sheet of flexible material present in the capsules of FIGS. 1 to 3.
Figure 13:
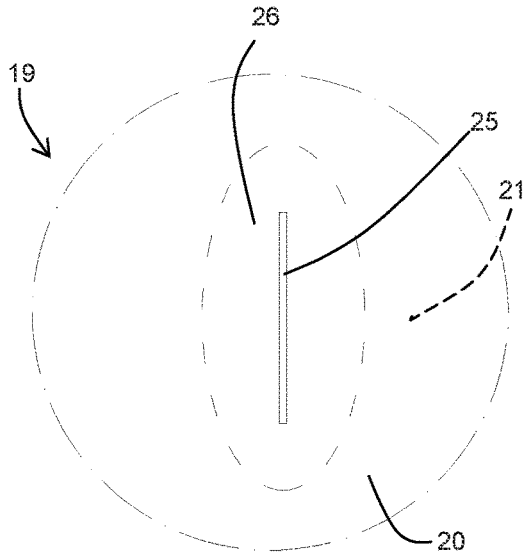
FIG. 13 is an enlarged view of one of the four dispensing zones of the sheet of flexible material of FIG. 12.

Depending on the embodiments, the sheet of flexible material 19 is positioned either between the lower filtering element 14 and the dispensing hole 9 (preferred solution illustrated in the accompanying figures) or between the powdered food substance 2 and the lower filtering element 14 (less preferred solution). In the preferred embodiments, the sheet of flexible material 19 is fixed to the containment body 3 at the middle annular zone 12. Only its central zone is facing the inner annular zone 11 and the dispensing hole 9. In this case too, the fixing is normally performed by sealing or gluing. According to the main inventive aspect of this invention, the first layer 20 preferably comprises one or more cuts 25 (as illustrated in FIGS. 12 and 13) or alternatively one or more through openings (solution not illustrated). Both the cuts 25 and the through openings may be made with a laser beam (in this way, it is possible to make them when the first layer 20 and the second layer 21 are already coupled, thanks to the fact that by using a laser beam with suitable power it is possible to cut the polyethylene but not the aluminium, which simply reflects it). It should be noticed that in the above-mentioned figures the thickness of the cut 25 is shown larger than is necessary, in order to make it more obvious. In fact, in the preferred embodiments, whilst the length of the cut 25 is advantageously approximately several millimetres, preferably between 1 and 10 mm, the width of the cut 25 is approximately 0.5 to 1 mm.

As is schematically illustrated in FIGS. 12, 13, 14 and 16, each cut 25 or through opening present in the first layer 20 is made at and in a dispensing zone 26 of the first layer 20. Each dispensing zone 26 is characterised in that, at it, the first layer 20 is locally detached from the second layer 21 (for example, for that purpose advantageously the layer of adhesive 22 may be locally absent, as indicated by the empty area 27 in FIGS. 14 and 16). In fact, in this way, in use, after an overpressure has been established at the face of the first layer 20 facing the powdered food substance 2, the same pressure also acts on the second layer 21 at the dispensing zone 26, where the second layer 21 is locally free to swell, deforming towards the bottom portion 5 until it bursts.

Advantageously, all of the cuts 25 and the dispensing zones are made at the central zone of the sheet of flexible material 19.

Whilst, as already indicated, in general the containment body 3 may be made using any material and any method (for example by injection moulding), in accordance with a second innovative aspect of this invention the containment body 3 is made by thermoforming a plastic material that is a barrier to oxygen, with the dispensing hole 9 made by die cutting, and the capsule 1 also comprises a dispensing element 28 that is constituted of moulded plastic material and that is coupled to the dispensing hole 9.

In detail 25, the dispensing element 28 comprises a tubular main body 29 which is inserted through the dispensing hole 9 so that it projects towards the outside of the capsule 1, and which internally comprises an outfeed hole 30 for the beverage. The outfeed hole 30 connects the containment chamber 6 to the outside. The tubular main body 29 also comprises, advantageously, a radial flange 31 placed so that it is resting on the bottom portion 5 (in particular on the inner annular zone 11 in the embodiments illustrated).

Depending on the embodiments, the dispensing element 28 may be mounted in the dispensing hole 9 either in a fluid-tight way or not.

Moreover, preferably, the dispensing element 28 comprises at least one undercut seat 32, relative to the central axis, in which a portion of the containment body 3, which delimits the dispensing hole 9, is inserted with a snap-in action.

Figure 17:
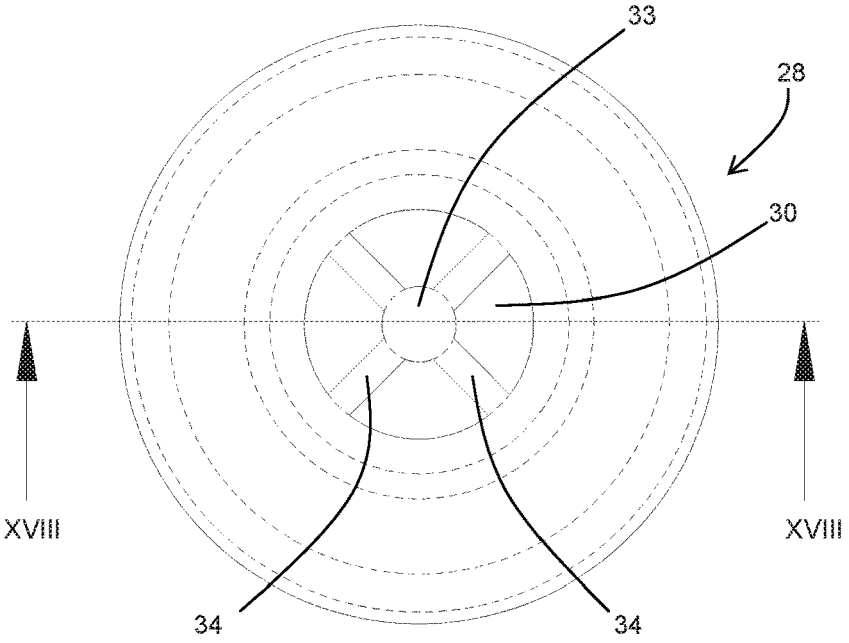
FIG. 17 is a top view of the dispensing element of the capsules of FIGS. 1 and 2.
Figure 18:
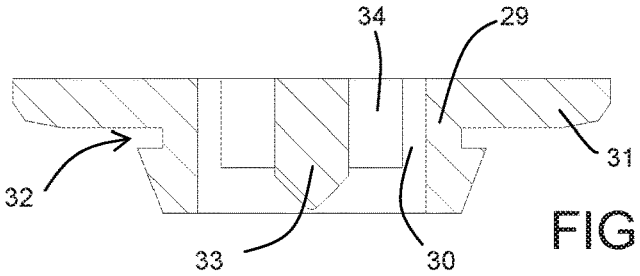
FIG. 18 is a side section view of the dispensing element of FIG. 17 sectioned according to the line XVII-XVII.
Figure 19:
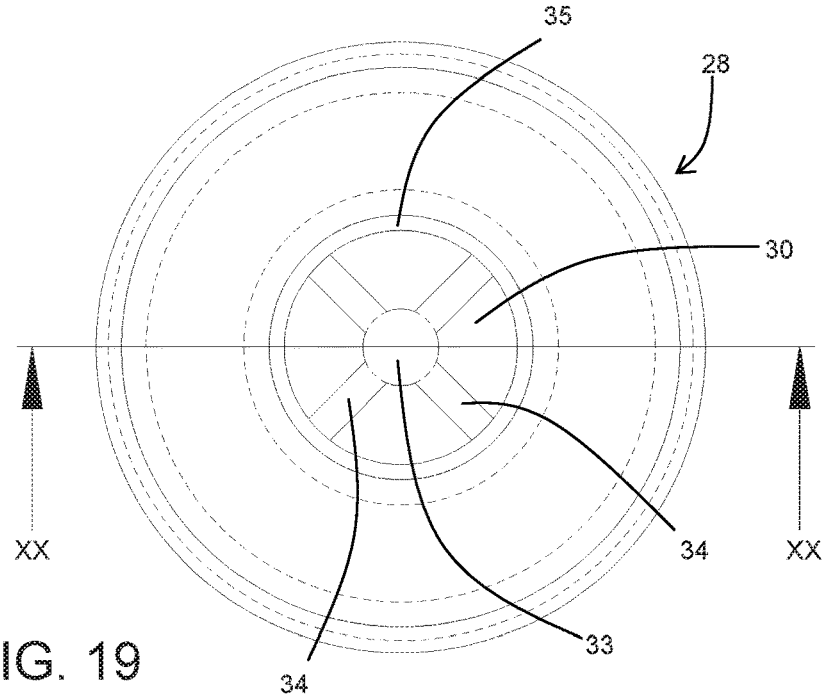
FIG. 19 is a top view of the dispensing element of the capsule of FIG. 3.
Figure 20:
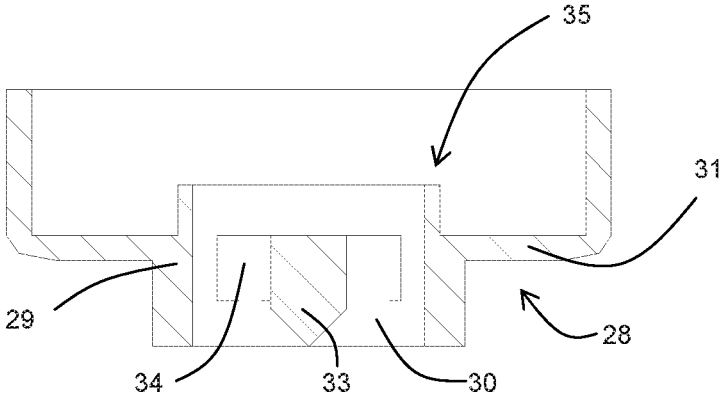
FIG. 20 is a side section view of the dispensing element of FIG. 19 sectioned according to the line XX-XX.
Figure 21:
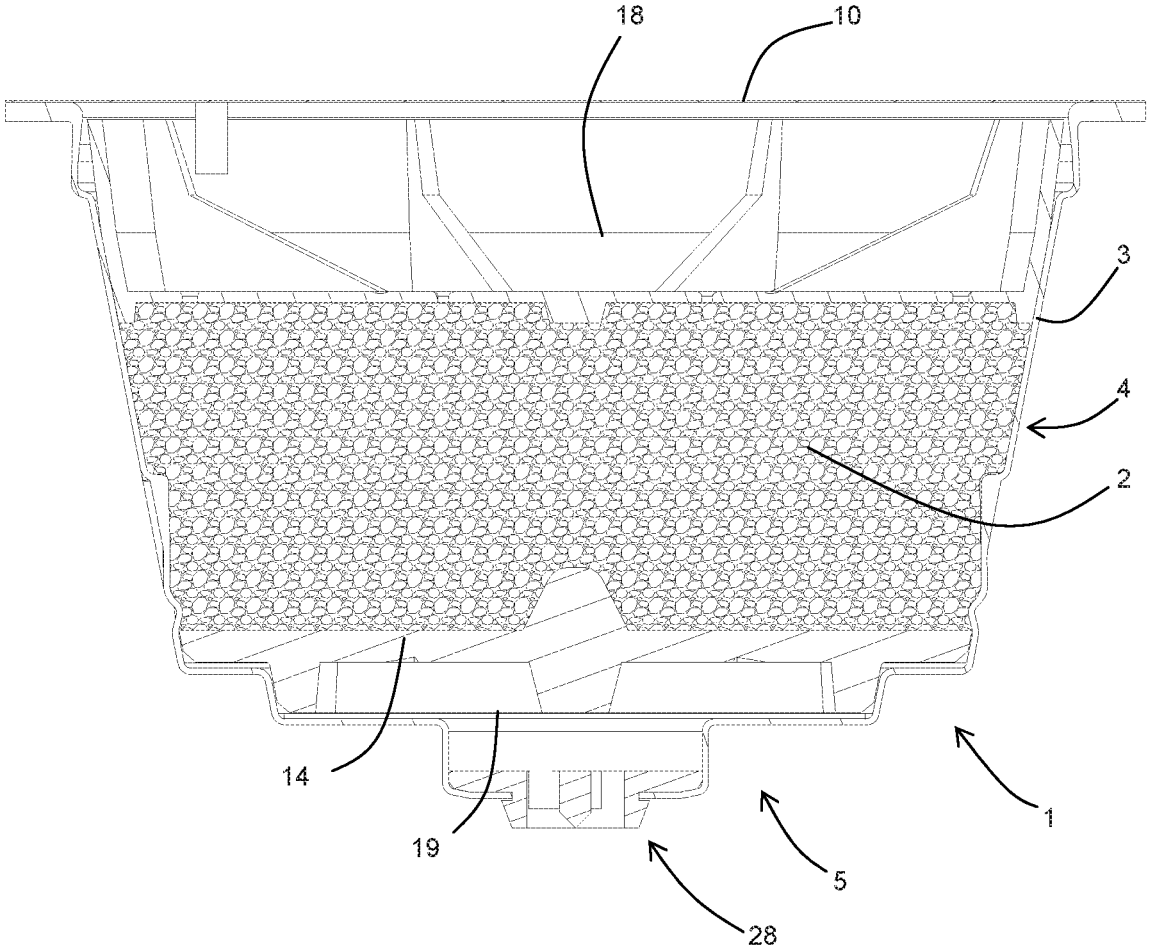
FIG. 21 is an axial section of the capsule of FIG. 1 filled with the powdered food substance.

Furthermore, advantageously, the tubular main body 29 may comprise a guiding element 33 located in a central position of the outfeed hole 30 and supported by several supporting and centring arms 34. Preferably, the guiding element 33 has a tapered lower end (conical in the accompanying figures) to guarantee dispensing of the beverage along the central axis. Moreover, in the embodiment of FIGS. 19 and 20, on a side of it facing the lower filtering element 14, the dispensing element 28 also comprises a projecting annular edge 35 that surrounds the entrance of the outfeed hole 30 and that is able to obstruct the outflow of any residual drops of beverage present in the capsule 1 at the moment when the used capsule is removed from the extracting machine. A similar projecting annular edge 35 may also be present in the embodiment of FIGS. 17 and 18, and in any other embodiment of the dispensing element 28.

As regards operation of the capsule 1, when it is inserted in the coffee machine, the machine pierces the closing element 10 and injects pressurised water through the closing element 10. After passing through an upper filtering element 18, if present in the capsule 1, the water reaches the powdered food substance 2, and wets it, beginning the beverage making process, that is to say, dissolving of the powdered food substance 2 if it is soluble, or extraction of the aromatic substances if the powdered food substance 2 is not soluble.

The beverage formed then reaches the sheet of flexible material 19 that is still intact and is stopped by it. In particular, especially after the increase in pressure inside the capsule 1, the beverage goes into the one or more through holes or openings made in the first layer 20 and reaches the second layer 21 at the dispensing zones. The gradually established difference in the pressure acting on the face of the sheet of flexible material 19 facing the powdered food substance 2 and on the opposite face causes the second layer 21 to swell towards the bottom portion 5 at the one or more dispensing zones present, until the second layer 21 tears at one or more of the dispensing zones. It should be noticed that the different mechanical properties of the materials that constitute the first layer 20 and the second layer 21 mean that, whilst the second layer 21 tears following the increase in pressure, the first layer 20 remains substantially undamaged.

At that point, the beverage is free to continue on its path towards the outfeed hole 30. If it is present, the beverage in particular reaches the dispensing element 28, where it goes into the outfeed hole 30, preferably following the guiding element 33 along its length, to reach the cup below.

It should be noticed that, during the outfeed path, the beverage also passes through the lower filtering element 14. Depending on the embodiments, that may occur either before the beverage passes through the sheet of flexible material 19 or after the beverage has passed through it.

Finally, if the sheet of flexible material 19 comprises through cuts 25 that have a reduced transversal width (measuring approximately 0.5 to 1 mm), thanks to the elasticity of the polypropylene during dispensing, those cuts 25 can guarantee that the pressure inside the capsule 1 remains constant (the cuts stretch wider open if the pressure increases and become narrower if the pressure drops), thereby guaranteeing improved beverage extraction, particularly in the case of a powdered food substance 2 that is not soluble.

This invention brings important advantages.

Moreover, in fact, thanks to this invention it has been possible to provide an alternative capsule to the prior art capsules. This alternative capsule can be used in the same machines that currently use the prior art capsules described above, but improved results have even been achieved.

First, thanks to the innovative sheet of flexible material used, it has been possible to provide a capsule opening system that is not just an alternative to the prior art system, but that allows both opening with pressures higher than those at which opening occurs in prior art capsules, and a reduced risk of unwanted release of pieces of aluminium in the beverage, thanks to the absence of mechanical piercing elements that interact with the aluminium sheet.

Moreover, as already indicated, in the preferred embodiment in which the sheet of flexible material comprises through cuts that have a reduced transversal width, it is possible to guarantee improved beverage extraction.

Second, in the case of the preferred embodiment, thanks to the use of the additional dispensing element, it has been possible to use thermoformed containment bodies in place of the injection moulded bodies used until now.

Finally, it should be noticed that this invention is relatively easy to produce and that even the cost linked to implementing the invention is not very high.

The invention described above may be modified and adapted in several ways without thereby departing from the scope of the inventive concept.

All details may be substituted with other technically equivalent elements and the materials used, as well as the shapes and dimensions of the various components, may vary according to requirements.

The invention claimed is:

1. A capsule for making beverages, containing a powdered food substance (2) which allows a beverage to be made by passing hot water through the powdered food substance, the capsule (1) comprising:

a cup-shaped containment body (3) in turn comprising a tubular lateral wall (4) extending between a first edge (7) and a second edge (8), and a bottom portion (5) connected to the first edge (7) and extending transversally to a central axis of the tubular lateral wall (4), the bottom portion (5) comprising a dispensing hole (9), and the containment body (3) defining a containment chamber (6);

a closing element (10) fixed to the second edge (8) for closing the top of the containment body (3);

a lower filtering element (14) mounted in the containment chamber (6) and positioned between the powdered food substance (2) and the bottom portion (5); and a sheet of flexible material (19), impermeable to oxygen, mounted in the containment chamber (6) and fixed in an oxygen-tight way to the containment body (3), the sheet of flexible material (19) comprising at least, one first layer (20) constituted of a film made of plastic material and one second layer (21) constituted of an aluminium film, the sheet of flexible material (19) comprising one or more first zones and one or more dispensing zones (26), in each first zone a respective portion of the one first layer (20) and a respective portion of the one second layer (21) being adjacent to each other and being locally sealed to each other, in each dispensing zone (26) the one first layer (20) and the one second layer (21) being locally detached from each other, each of the one or more dispensing zones (26) being surrounded by a perimeter defined by one or more of said first zones, the sheet of flexible material (19) being positioned between the powdered food substance (2) and the dispensing hole (9) with the one first layer (20) interposed between the powdered food substance (2) and the one second layer (21);

characterised in that the one first layer (20) comprises one or more cuts (25) or through openings, and in that for each of said cuts (25) or through openings there is located one of said one or more dispensing zones (26) that surrounds the respective cut (25) or through opening, for allowing at each of the one or more dispensing zones (26) the one second layer (21) to swell towards the bottom portion (5) until the one second layer (21) bursts after an increase in pressure on the side of the one first layer (20) facing the powdered food substance (2).

2. The capsule according to claim 1, wherein, at the one or more first zones, the one first layer (20) and the one second layer (21) are locally sealed to each other by a layer of adhesive (22).

3. The capsule according to claim 1, characterised in that the sheet of flexible material (19) also comprises a layer (24) of intertwined plastic fibres, the one second layer (21) being interposed between the one first layer (20) and the layer (24) of intertwined plastic fibres.

4. The capsule according to claim 3, characterised in that the layer (24) of intertwined plastic fibres is constituted of woven or non-woven polyester.

5. The capsule according to claim 1, characterised in that the one first layer (20) is constituted of polyethylene.

6. The capsule according to claim 1, characterised in that the bottom portion (5) of the containment body (3) comprises an inner annular zone (11) that surrounds the dispensing hole (9), a middle annular zone (12) that surrounds the inner annular zone (11) and an outer annular zone (13) that surrounds the middle annular zone (12), the inner annular zone (11) being further from the closing element (10) than the middle annular zone (12) and the middle annular zone (12) being further from the closing element (10) than the outer annular zone (13); the inner annular zone (11), the middle annular zone (12) and the outer annular zone (13) each forming a supporting surface extending transversally relative to the central axis; the lower filtering element (14) resting on the outer annular zone (13) and the sheet of flexible material (19) being fixed to the containment body (3) at the middle annular zone (12).

7. The capsule according to claim 1, characterised in that the sheet of flexible material (19) is positioned between the lower filtering element (14) and the dispensing hole (9).

8. The capsule according to claim 1, characterised in that the capsule also comprises an upper filtering element (18) positioned between the closing element (10) and the powdered food substance (2).

9. The capsule according to claim 8, characterised in that the upper filtering element (18) is constituted of a rigid or semi-rigid plastic element.

10. The capsule according to claim 1, characterised in that the lower filtering element (14) is constituted of a rigid or semi-rigid plastic element.

11. The capsule according to claim 1, characterised in that the containment body (3) is made by thermoforming, in that the capsule also comprises a dispensing element (28) constituted of moulded plastic material, and in that the dispensing element (28) comprises a tubular main body (29) which is inserted through the dispensing hole (9) and which internally comprises an outfeed hole (30) for the beverage that connects the containment chamber (6) to the outside of the capsule.

12. The capsule according to claim 11, characterised in that the dispensing element (28) is mounted in the dispensing hole (9) in a fluid-tight way.

13. The capsule according to claim 11, characterised in that the dispensing element (28) comprises at least one undercut seat (32) relative to the central axis and in that a portion of the containment body (3), which delimits the dispensing hole (9), is inserted in the undercut seat (32) with a snap-in action.

14. The capsule according to claim 11, characterised in that the tubular main body (29) also comprises a guiding element (33) located in a central position of the outfeed hole (30).

15. The capsule according to claim 11, wherein the bottom portion (5) of the containment body (3) comprises an inner annular zone (11) that surrounds the dispensing hole (9), a middle annular zone (12) that surrounds the inner annular zone (11) and an outer annular zone (13) that surrounds the middle annular zone (12), the inner annular zone (11) being further from the closing element (10) than the middle annular zone (12) and the middle annular zone (12) being further from the closing element (10) than the outer annular zone (13); the inner annular zone (11), the middle annular zone (12) and the outer annular zone (13) each forming a supporting surface extending transversally relative to the central axis; the lower filtering element (14) resting on the outer annular zone (13) and the sheet of flexible material (19) being fixed to the containment body (3) at the middle annular zone (12), the capsule being characterised in that the tubular main body (29) is positioned resting on the inner annular zone (11).

16. The capsule according to claim 11, characterised in that, on a side of the dispensing element facing the lower filtering element (14), the dispensing element (28) also comprises a projecting annular edge (35) that surrounds an entrance of the outfeed hole (30).

17. The capsule according to claim 1, wherein the sheet of flexible material (19) comprises a layer of lacquer (23) applied to the one second layer (21) on a side opposite to that facing the one first layer (20).

18. The capsule according to claim 1, wherein the one first layer (20) and the one second layer (21) are locally sealed to each other at all zones of the sheet of flexible material (19) except the one or more dispensing zones (26).

19. The capsule according to claim 1, wherein the one first layer (20) and the one second layer (21) are locally sealed to each other by a layer of adhesive (22) at all zones of the sheet of flexible material (19) except the one or more dispensing zones (26).

* * * * *